US008782978B1

(12) United States Patent
Frenette et al.

(10) Patent No.: US 8,782,978 B1
(45) Date of Patent: Jul. 22, 2014

(54) POST FOOTING DEVICE

(71) Applicants: Gerry Frenette, Amherst, NY (US); Richard Frenette, Amherst, NY (US)

(72) Inventors: Gerry Frenette, Amherst, NY (US); Richard Frenette, Amherst, NY (US)

( * ) Notice: Subject to any disclaimer, the term of this patent is extended or adjusted under 35 U.S.C. 154(b) by 0 days.

(21) Appl. No.: 14/048,503

(22) Filed: Oct. 8, 2013

(51) Int. Cl.
*E02D 27/42* (2006.01)
*E04H 12/22* (2006.01)

(52) U.S. Cl.
USPC ..... 52/296; 52/169.13; 52/294; 52/297; 52/169.9; 52/170; 248/519; 248/530; 248/541; 405/231; 405/244; 405/256; 405/232

(58) Field of Classification Search
USPC ..... 52/244, 169.13, 170, 169.9, 292–298; 248/159, 548, 156, 530, 541, 519; 405/244, 256, 249, 231–232; 254/104; 285/339, 342
See application file for complete search history.

(56) References Cited

U.S. PATENT DOCUMENTS

| | | | | |
|---|---|---|---|---|
| 3,396,541 | A * | 8/1968 | Lamberton | 405/50 |
| 4,242,851 | A * | 1/1981 | Pohlman et al. | 52/848 |
| 4,272,929 | A * | 6/1981 | Hanson | 52/40 |
| 4,604,250 | A | 8/1986 | Ecker | |
| 5,050,356 | A * | 9/1991 | Johnson et al. | 52/295 |
| 5,328,142 | A | 7/1994 | Weekers | |
| 5,355,642 | A * | 10/1994 | Palamarz | 52/73 |
| 6,742,314 | B2 * | 6/2004 | Young | 52/835 |
| 7,003,919 | B2 * | 2/2006 | Riker | 52/170 |
| 7,325,790 | B2 | 2/2008 | Lee | |
| 7,874,540 | B2 | 1/2011 | Niu | |
| 7,942,612 | B1 | 5/2011 | Willison | |
| 8,313,080 | B2 | 11/2012 | Fournier et al. | |
| 8,484,915 | B1 * | 7/2013 | Abbas et al. | 52/223.4 |
| 2002/0139069 | A1 | 10/2002 | Buffkin et al. | |
| 2003/0145556 | A1 * | 8/2003 | Young | 52/736.1 |
| 2006/0016150 | A1 | 1/2006 | Fournier | |
| 2009/0320396 | A1 * | 12/2009 | Knudsen | 52/297 |

* cited by examiner

*Primary Examiner* — Jeanette E. Chapman

(57) ABSTRACT

A post footing device facilitates replacement of broken posts. The device includes a tube having an upper end, a lower end, and a perimeter wall extending between the upper end and the lower end. A sleeve has a top end, a bottom end, and a peripheral wall extending between the top end and the bottom end. The sleeve is insertable into the tube and configured for receiving and laterally supporting a post. Each of a plurality of alignment bars extends between the tube and the sleeve wherein the sleeve is held in position within the tube. The alignment bars are spaced around the sleeve such that the alignment bars align the sleeve in the tube. A support is positioned in the sleeve between the top end and the bottom end wherein the support is configured for supporting the post in the sleeve above the bottom end.

11 Claims, 5 Drawing Sheets

POST FOOTING DEVICE

BACKGROUND OF THE DISCLOSURE

Field of the Disclosure

The disclosure relates to footing devices and more particularly pertains to a new footing device for facilitating replacement of broken posts.

SUMMARY OF THE DISCLOSURE

An embodiment of the disclosure meets the needs presented above by generally comprising a tube having an upper end, a lower end, and a perimeter wall extending between the upper end and the lower end. A sleeve has a top end, a bottom end, and a peripheral wall extending between the top end and the bottom end. The sleeve is insertable into the tube and configured for receiving and laterally supporting a post. Each of a plurality of alignment bars extends between the tube and the sleeve wherein the sleeve is held in position within the tube. The alignment bars are spaced around the sleeve such that the alignment bars align the sleeve in the tube. A support is positioned in the sleeve between the top end and the bottom end wherein the support is configured for supporting the post in the sleeve above the bottom end.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
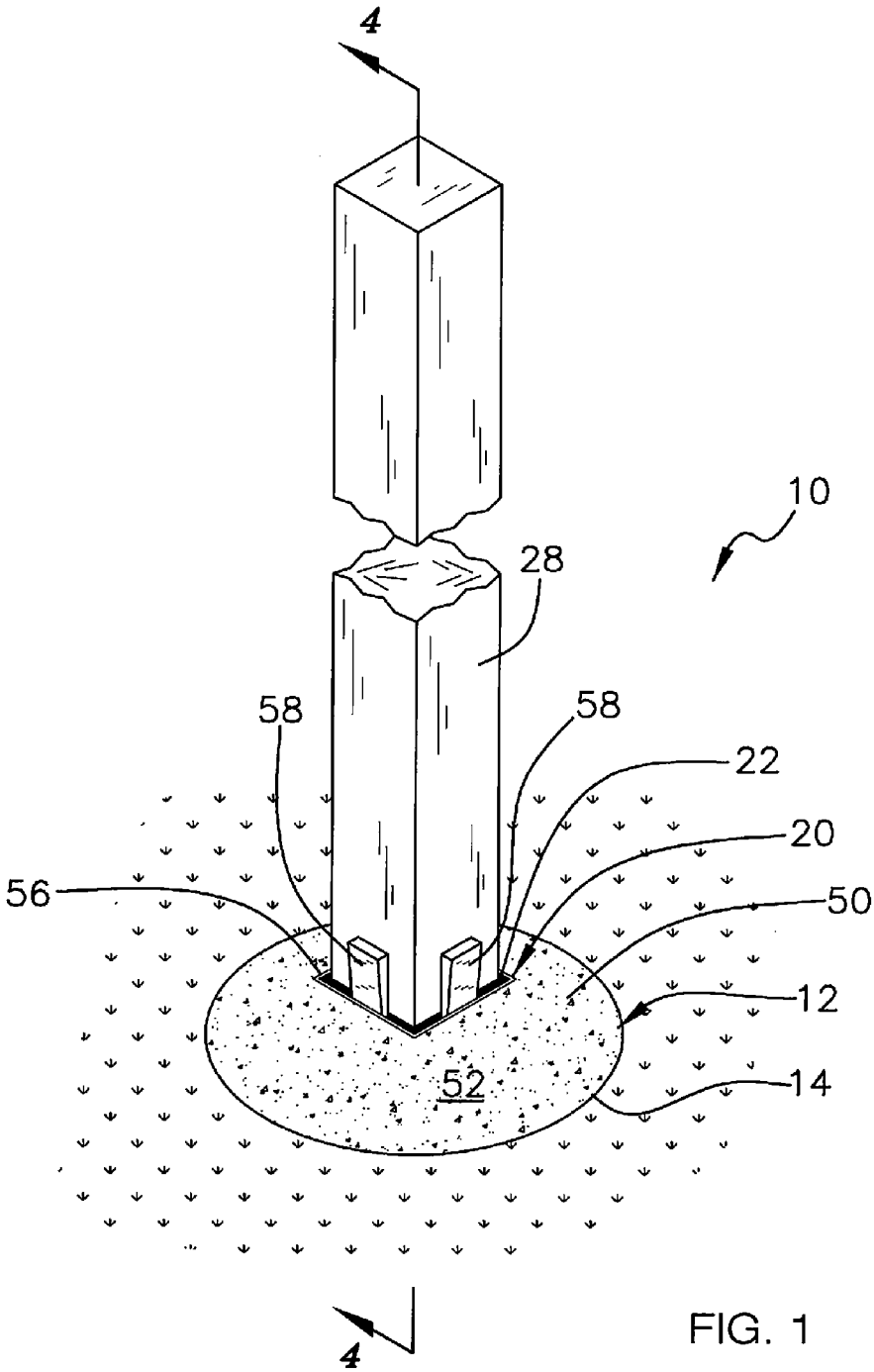
FIG. 1 is a top front side perspective view of a post footing device according to an embodiment of the disclosure.
Figure 2:
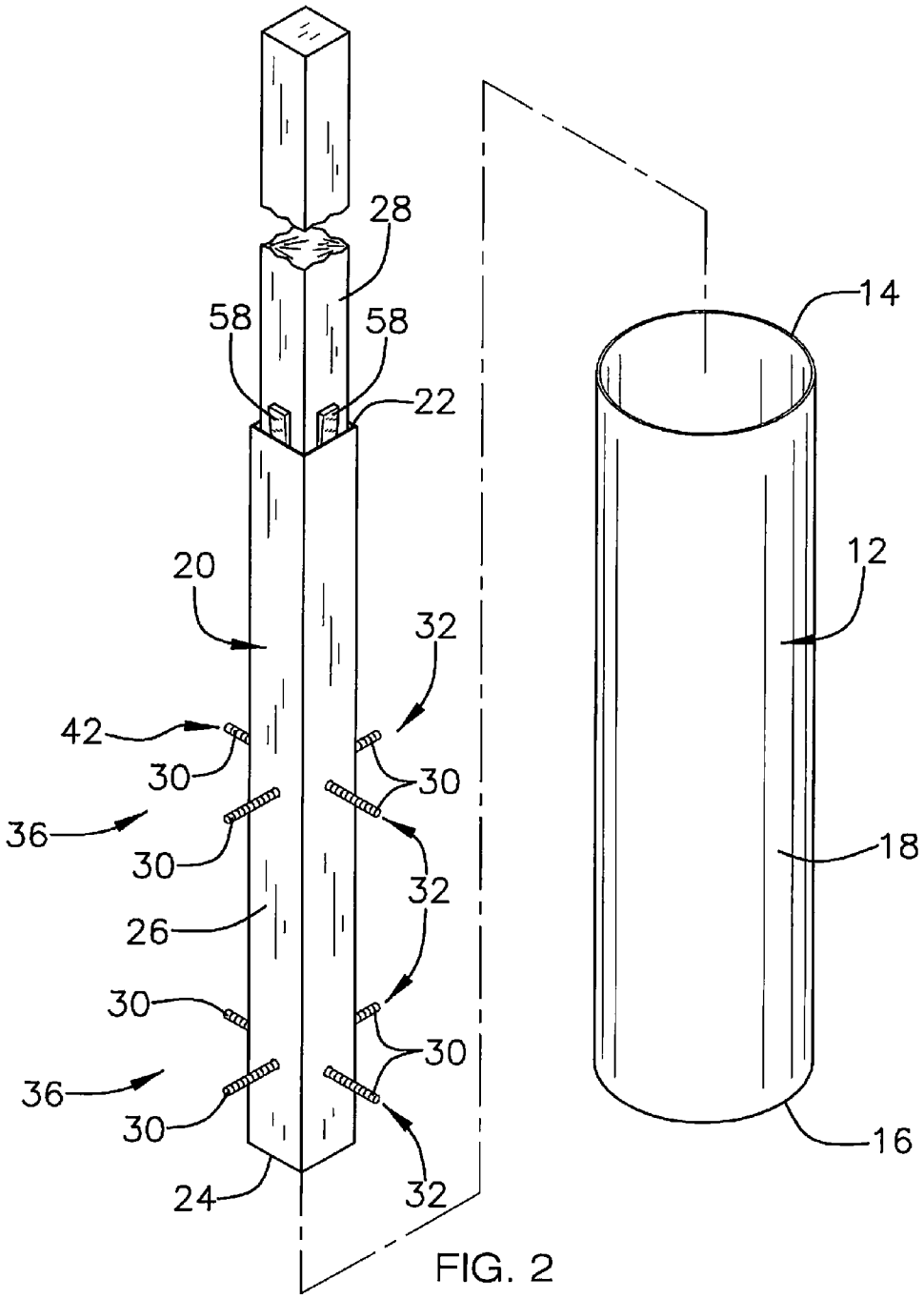
FIG. 2 is a partially exploded top front side perspective view of an embodiment of the disclosure.
Figure 3:
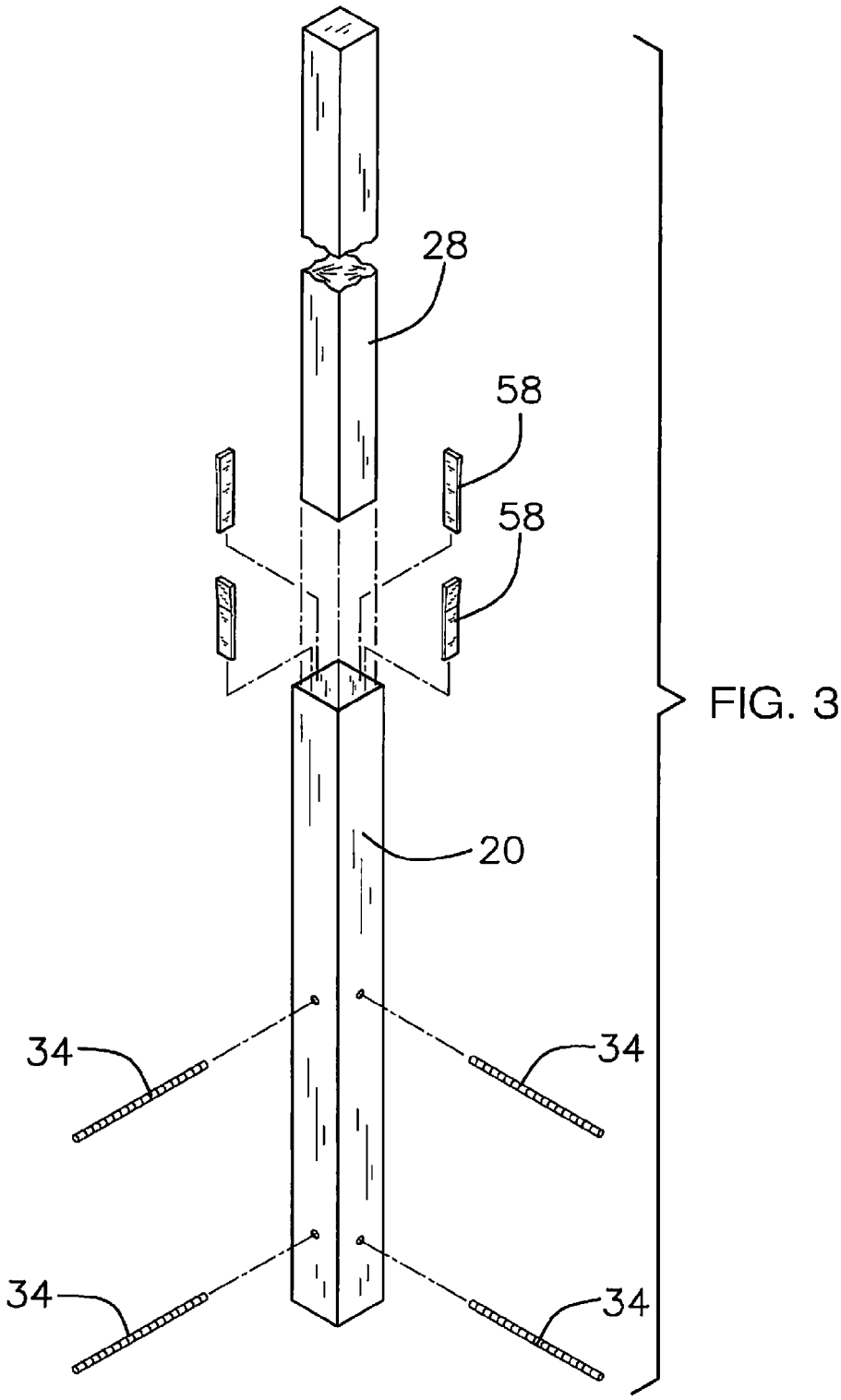
FIG. 3 is an exploded top front side perspective view of an embodiment of the disclosure.
Figure 4:
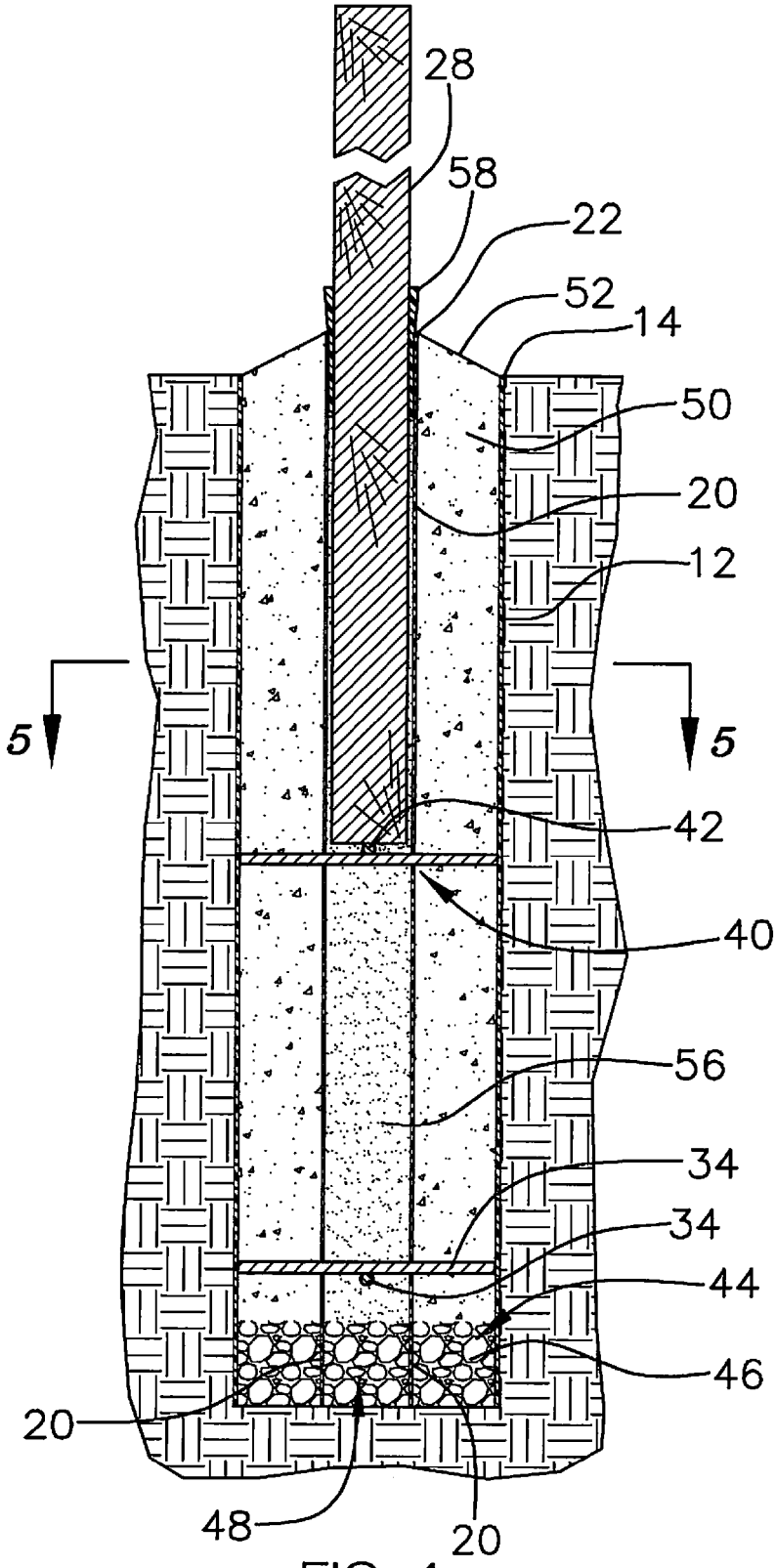
FIG. 4 is a cross-sectional view of an embodiment of the disclosure taken along line 4-4 of FIG. 1.
Figure 5:
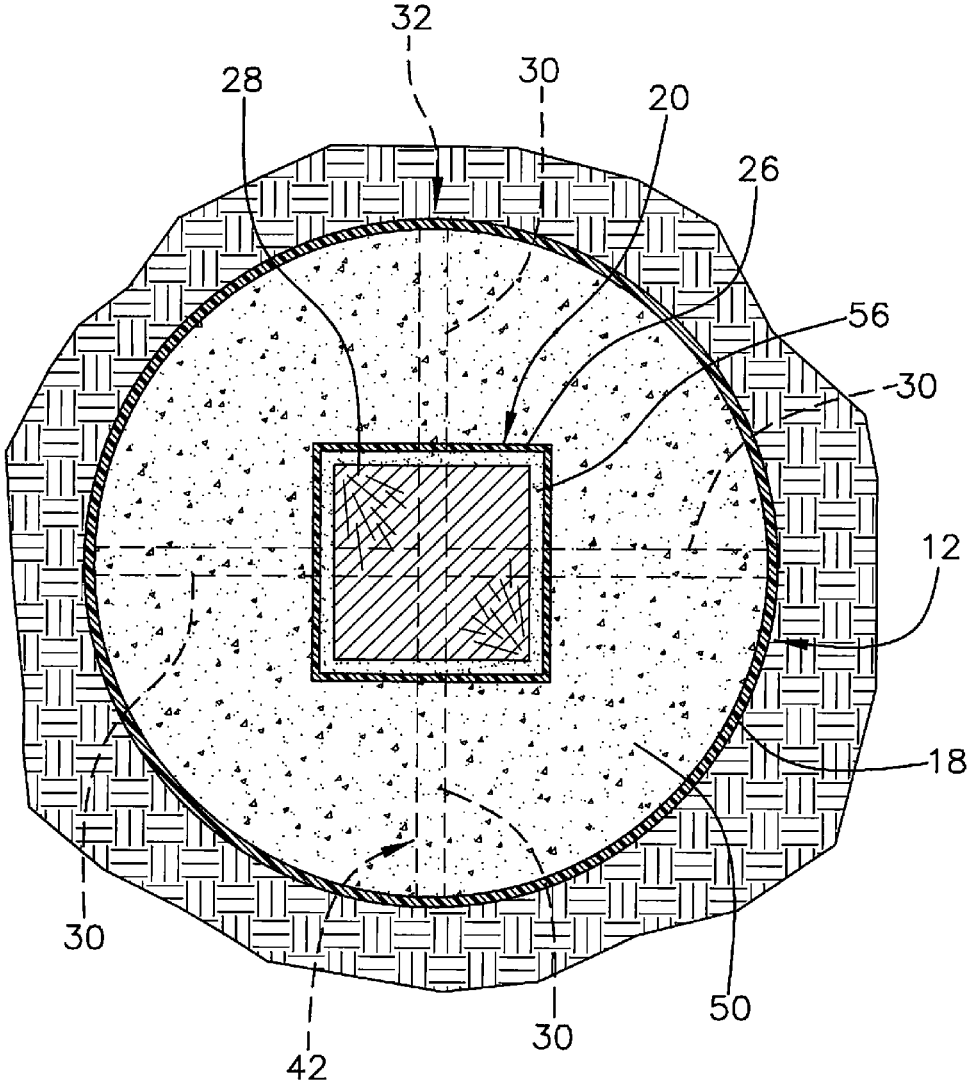
FIG. 5 is a cross-sectional view of an embodiment of the disclosure taken along line 5-5 of FIG. 4.

With reference now to the drawings, and in particular to FIGS. 1 through 5 thereof, a new footing device embodying the principles and concepts of an embodiment of the disclosure and generally designated by the reference numeral 10 will be described.

As best illustrated in FIGS. 1 through 5, the post footing device 10 generally comprises a tube 12 having an upper end 14, a lower end 16, and a perimeter wall 18 extending between the upper end 14 and the lower end 16. The tube 12 may have a circular transverse cross-sectional shape. A sleeve 20 has a top end 22, a bottom end 24, and a peripheral wall 26 extending between the top end 22 and the bottom end 24. The sleeve 20 is insertable into the tube 12. The sleeve 20 is configured for receiving and laterally supporting a post 28. The sleeve 20 has a square transverse cross-sectional shape to accommodate most conventional fence or deck posts but may be constructed to have a shape complementary to any post shape. The top end 22 of the sleeve 20 is vertically spaced above the upper end 14 of the tube 12 when the sleeve 20 is positioned in the tube 12.

Each of a plurality of alignment bars 30 extends between the tube 12 and the sleeve 20 wherein the sleeve 20 is held in position within the tube 12. The alignment bars 30 are spaced around the sleeve 20 wherein the alignment bars 30 align the sleeve 20 in the tube 12 holding the tube 20 in parallel relationship to the tube 12. The alignment bars 30 are arranged into a plurality of linearly aligned pairs 32. Each aligned pair 32 of alignment bars 30 may be formed by a single bar 34 extending through the sleeve 20. The alignment bars 30 may be further arranged into a plurality of sets 36 of alignment bars 30. Each set 36 of alignment bars 30 comprises vertically adjacent transversely oriented pairs of the aligned pairs 32 of the alignment bars 30.

A support 40 is positioned in the sleeve 20 between the top end 22 and the bottom end 24 wherein the support 40 is configured for supporting the post 28 in the sleeve 20 above the bottom end 24. The support 40 may be aligned with an associated aligned pair 32 of the alignment bars 30 wherein the support 40 is coplanar with the associated aligned pair 32 of alignment bars 30. The support 40 may comprise an uppermost one 42 of the aligned pairs 32 of the alignment bars 30. The support 40 may further comprise an uppermost one of the sets 36 of alignment bars 30 with the lower aligned pair 32 abutting the uppermost one 42 of the aligned pairs 32 of the alignment bars 30.

For installation of the device 10, a layer 44 of drain stone 46 is positioned in the tube 12. The sleeve 20 extends into the layer 44 of drain stone 46 wherein a medial portion 48 of the layer 44 of drain stone 46 is positioned in the sleeve 20. Concrete 50 is positioned between the tube 12 and the sleeve 20 wherein the sleeve 20 is held in position within the tube 12 by the concrete 50. The drain stone 46 is positioned under the concrete 50 and the concrete may fill the space between the tube 12 and the sleeve 20. The concrete 50 has an upper surface 52 sloping downwardly and away from the sleeve 20 towards the upper end 14 of the tube 12 to promote drainage away from the post 28. Sand 56 is positioned in the sleeve 20 extending downwardly from the support 40 to the drain stone 46 permitting fluids to drain away from the post 28 within the sleeve 20. Shims 58 may be inserted between the sleeve 20 and the post 28 to adjust the post 28 to a vertical position.

In use, the tube 12 and sleeve 20 are inserted into a hole extending into the ground. The drain stone 46, concrete 50 and sand 56 are positioned in the tube 12 and sleeve 20 as described above. The post 28 may be inserted into the sleeve 20 and shimmed to be vertical. Additional space between the post 28 and the sleeve 12 may be filled with sand 56. The post 28 may be replaced by lifting the post 28 out of the sleeve 20. A new post may then be positioned in the sleeve 20 and shimmed without having to set a new footing for the new post.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A post footing device comprising:

a tube having an upper end, a lower end, and a perimeter wall extending between said upper end and said lower end;

a sleeve having a top end, a bottom end, and a peripheral wall extending between said top end and said bottom end, said sleeve being insertable into said tube, said sleeve being configured for receiving and laterally supporting a post;

a plurality of alignment bars, each alignment bar extending between said tube and said sleeve wherein said sleeve is held in position within said tube, said alignment bars being spaced around said sleeve wherein said alignment bars align said sleeve in said tube;

a support positioned in said sleeve between said top end and said bottom end wherein said support is configured for supporting the post in said sleeve above said bottom end;

sand positioned in said sleeve, said sand extending downwardly from said support;

concrete positioned between said tube and said sleeve wherein said sleeve is held in position within said tube; and a layer of drain stone positioned in said tube under said concrete, said sleeve extending into said layer of drain stone wherein a medial portion of said layer of drain stone is positioned in said sleeve under said sand.

2. The device of claim 1, further comprising said tube having a circular transverse cross-sectional shape.

3. The device of claim 1, further comprising said sleeve having a square transverse cross-sectional shape.

4. The device of claim 1, further comprising said alignment bars being arranged into a plurality of linearly aligned pairs.

5. The device of claim 4, further comprising said support being aligned with an associated aligned pair of said alignment bars wherein said support is coplanar with said associated aligned pair of alignment bars.

6. The device of claim 4, further comprising each said aligned pair of alignment bars being formed by a single bar extending through said sleeve.

7. The device of claim 6, further comprising said support comprising an uppermost one of said aligned pairs of said alignment bars.

8. The device of claim 6, further comprising said alignment bars being arranged into a plurality of sets of alignment bars, each set of alignment bars comprising vertically adjacent transversely oriented pairs of said aligned pairs of said alignment bars.

9. The device of claim 8, further comprising said support comprising an uppermost one of said sets of alignment bars.

10. The device of claim 1, further comprising:

concrete positioned between said tube and said sleeve wherein said sleeve is held in position within said tube; and said top end of said sleeve being vertically spaced above said upper end of said tube, said concrete having an upper surface sloping downwardly and away from said sleeve towards said upper end of said tube.

11. A post footing device comprising:

a tube having an upper end, a lower end, and a perimeter wall extending between said upper end and said lower end, said tube having a circular transverse cross-sectional shape;

a sleeve having a top end, a bottom end, and a peripheral wall extending between said top end and said bottom end, said sleeve being insertable into said tube, said sleeve being configured for receiving and laterally supporting a post, said sleeve having a square transverse cross-sectional shape, said top end of said sleeve being vertically spaced above said upper end of said tube;

a plurality of alignment bars, each alignment bar extending between said tube and said sleeve wherein said sleeve is held in position within said tube, said alignment bars being spaced around said sleeve wherein said alignment bars align said sleeve in said tube, said alignment bars being arranged into a plurality of linearly aligned pairs, each said aligned pair of alignment bars being formed by a single bar extending through said sleeve, said alignment bars being arranged into a plurality of sets of alignment bars, each set of alignment bars comprising vertically adjacent transversely oriented pairs of said aligned pairs of said alignment bars;

a support positioned in said sleeve between said top end and said bottom end wherein said support is configured for supporting the post in said sleeve above said bottom end, said support being aligned with an associated aligned pair of said alignment bars wherein said support is coplanar with said associated aligned pair of alignment bars, said support comprising an uppermost one of said aligned pairs of said alignment bars, said support comprising an uppermost one of said sets of alignment bars;

sand positioned in said sleeve, said sand extending downwardly from said support;

concrete positioned between said tube and said sleeve wherein said sleeve is held in position within said tube, said concrete having an upper surface sloping downwardly and away from said sleeve towards said upper end of said tube; and a layer of drain stone positioned in said tube under said concrete, said sleeve extending into said layer of drain stone wherein a medial portion of said layer of drain stone is positioned in said sleeve under said sand.

* * * * *